US009988884B2

(12) United States Patent
Provost

(10) Patent No.: US 9,988,884 B2
(45) Date of Patent: Jun. 5, 2018

(54) ANNULAR SCREEN COMMUNICATION SYSTEM

(71) Applicant: BAKER HUGHES INCORPORATED, Houston, TX (US)

(72) Inventor: Wilfred Provost, Saint Martinsville, LA (US)

(73) Assignee: Baker Hughes, a GE company, LLC, Houston, TX (US)

( * ) Notice: Subject to any disclaimer, the term of this patent is extended or adjusted under 35 U.S.C. 154(b) by 323 days.

(21) Appl. No.: 14/754,198

(22) Filed: Jun. 29, 2015

(65) Prior Publication Data

US 2016/0376876 A1 Dec. 29, 2016

(51) Int. Cl.
*E21B 43/08* (2006.01)
*E21B 43/04* (2006.01)
*E21B 34/06* (2006.01)

(52) U.S. Cl.
CPC ..... *E21B 43/08* (2013.01); *E21B 34/06* (2013.01); *E21B 43/045* (2013.01)

(58) Field of Classification Search
CPC ..... E21B 43/08; E21B 43/04
USPC ..... 166/236, 205, 235
See application file for complete search history.

(56) References Cited

U.S. PATENT DOCUMENTS 5,787,980 A * 8/1998 Sparlin ..... E21B 43/088 166/231
5,931,229 A 8/1999 Lehr et al.
6,176,307 B1 * 1/2001 Danos ..... E21B 43/04 166/276
6,371,210 B1 * 4/2002 Bode ..... E21B 34/08 166/233
6,405,800 B1 * 6/2002 Walker ..... E21B 43/08 166/235
6,530,431 B1 3/2003 Castano-Mears et al.
6,776,241 B2 8/2004 Castano-Mears et al.
7,048,061 B2 * 5/2006 Bode ..... E21B 34/14 166/205
8,281,854 B2 10/2012 Gaudette et al.
8,511,380 B2 8/2013 Guignard et al.
8,567,498 B2 * 10/2013 Scott ..... E21B 43/084 166/230
8,602,096 B2 * 12/2013 Olenick ..... E21B 43/086 166/157
9,644,458 B2 * 5/2017 Vu ..... E21B 43/088
2003/0056959 A1 3/2003 Castano-Mears et al.
(Continued)

FOREIGN PATENT DOCUMENTS

WO 2009048846 A1 4/2009

OTHER PUBLICATIONS

Hailey, Travis, et al., "Improved Sand-Screen Design for Multi-Joint Flow Control", SPE-170283-MS; 2014, 1-18.

*Primary Examiner* — Kenneth L Thompson
(74) *Attorney, Agent, or Firm* — Steve Rosenblatt

(57) ABSTRACT

Screen sections have opposed open ends near the threaded connection of a base pipe and on opposed ends. The base pipes have premium threads for connection. A shroud is placed over the premium bases pipe connection that spans from one open ended screen section to another that is adjacent. Collectively a long annular space is created under the screens and alternating shrouds with access to within the base pipes provided preferably at opposed ends. The valve on one end takes returns during gravel packing and the other takes production to the surface.

19 Claims, 7 Drawing Sheets

(56) References Cited

U.S. PATENT DOCUMENTS

| | | | | |
|---|---|---|---|---|
| 2005/0251033 | A1 | 11/2005 | Scarantino et al. | |
| 2008/0289815 | A1 | 11/2008 | Moen et al. | |
| 2008/0308274 | A1* | 12/2008 | MacDougall | E21B 33/12 166/278 |
| 2013/0277053 | A1 | 10/2013 | Yeh et al. | |
| 2015/0034301 | A1 | 2/2015 | Kuo et al. | |
| 2015/0218906 | A1 | 8/2015 | Clem et al. | |
| 2015/0315881 | A1* | 11/2015 | Bowen | E21B 43/084 166/205 |
| 2016/0265318 | A1* | 9/2016 | Greci | E21B 43/08 |
| 2016/0369602 | A1* | 12/2016 | Frosell | E21B 33/12 |
| 2017/0016310 | A1* | 1/2017 | Greci | E21B 43/088 |

* cited by examiner

ANNULAR SCREEN COMMUNICATION SYSTEM

FIELD OF THE INVENTION

The field of the invention is multi-zone completions and more particularly completions that link screen sections with external shrouds mounted over connected base pipe with a single access to all the screen through a bottom isolation valve and production through all the screens with a top isolation valve.

BACKGROUND OF THE INVENTION

Multi-zone completions present conflicting design parameters that need to be considered. The need for versatility in being able to shut off individual screens has to be balanced with the resistance to flow that comes from additional tubulars associated with individual screens and the difficulty in channeling flow from one screen through small passages external to the central production flow path. Addition of tubular sections to create such communication paths between screens can also impede subsequent production by reducing the drift diameter available for such flow. The reduced drift dimension also makes access further downhole more complex or impossible in some cases.

FIG. 1-3 illustrate one such system. In FIG. 1 a port 10 on a sliding sleeve valve 12 is in the open position for taking gravel pack returns through screen 14. Arrows 16 represent the gravel slurry flow to the annular space outside screens 14, 20 and 22. Arrows 18 represent the gravel slurry return flow to the surface with the gravel 24 deposited outside screens 14, 20 and 22 as shown in FIG. 2. Because sliding sleeve valve 26 is closed all the return flow represented by arrow 18 is through ports 10 while connecting paths between screens such as 28 are closed. When it is time for production valves 12 and 26 are both opened as shown in FIG. 3. However, the path of least resistance is represented by arrows 30 and 32 as opposed to connecting paths such as 28. As a result, high velocities occur through the screens such as 14 and 22 causing erosion that can put a hole in such screens and further creating uneven flow from the formation as little flow gets to the surface through screen 20 that represents a path of higher resistance than flow coming in radially through screen 14 or 22. Apart from the above issues the presence of sleeves such as 30 to create the network of connecting passages 28 results in a smaller drift dimension for production flow and can reduce the production rate. Apart from this the assembly of such a string is fairly complex and presents many leak path opportunities. It fails to accomplish an objective of maximizing production in an even manner across the screens of the entire zone and is further expensive to construct and install into the borehole.

FIGS. 4-6 represent another prior system where perforations 32, 34 and 36 are sequentially made with a perforating gun that is not shown and the completion is assembled in the hole in stages as shown in FIGS. 4-6. Screen assemblies 36 and 38 are the same and they comprise a screen 40 covered internally by an inner pipe 42 to create an annular space 44 that is accessible by a sliding sleeve valve 46 to take returns when gravel packing. Valve 46 can then be closed when the screen that is associated with it is fully gravel packed. Further access to the annular space 44 is provided by pressure sensitive valves such as 48. These can operate in response to a pressure of a predetermined value that arms each of the similarly situated valves such as 50 and 52 such that when the pressure is released all the valves will open at the same time. The production can then ensue through screen assemblies 36 and 38 into the production string 54 that extends through production packer 56. Flow through screen assembly 58 passes through packer 60 and production packer 56 to come up around the production string 54 as represented by arrows 62. Arrows 64 represent the flow coming through screen assemblies 36 and 38 into the production string 54. The issue with this system is that once the zones are opened with valves 48, 50 and 52 the screens either cannot be closed off, or it is not economical to do so. The same valves can be inadvertently open with a pressure spike in the bottom hole assembly. The use of discrete inner tubulars such as 42 inside each screen also reduce drift diameter that can restrict production.

Also relevant to such systems are U.S. Pat. Nos. 8,511,380; 8,225,863; 6,530,431; 2004/0251033; U.S. Pat. Nos. 8,281,854; 6,776,241 and 20150034301.

The present invention seeks to overcome the shortcomings of the prior systems by using shrouds to span over a base pipe joint so as to create a continuous annular space between the screen assemblies and the base pipe so that the formation can flow more uniformly through a larger drift base pipe because the screens are coupled together. In this manner, a single valve can control return flow when gravel packing. Another valve communicating with the same exterior annular space can be used as the production valve drawing the fluid that is produced through all the screens in the screen assembly. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

Screen sections have opposed open ends near the threaded connection of a base pipe and on opposed ends. The base pipes have premium threads for connection. A shroud is placed over the premium bases pipe connection that spans from one open ended screen section to another that is adjacent. Collectively a long annular space is created under the screens and alternating shrouds with access to within the base pipes provided preferably at opposed ends. The valve on one end takes returns during gravel packing and the other takes production to the surface.

BRIEF DESCRIPTION OF THE DRAWINGS

FIG. 8 is the view of FIG. 7 with the well shut in;

DETAILED DESCRIPTION OF THE PREFERRED EMBODIMENT

Figure 1:
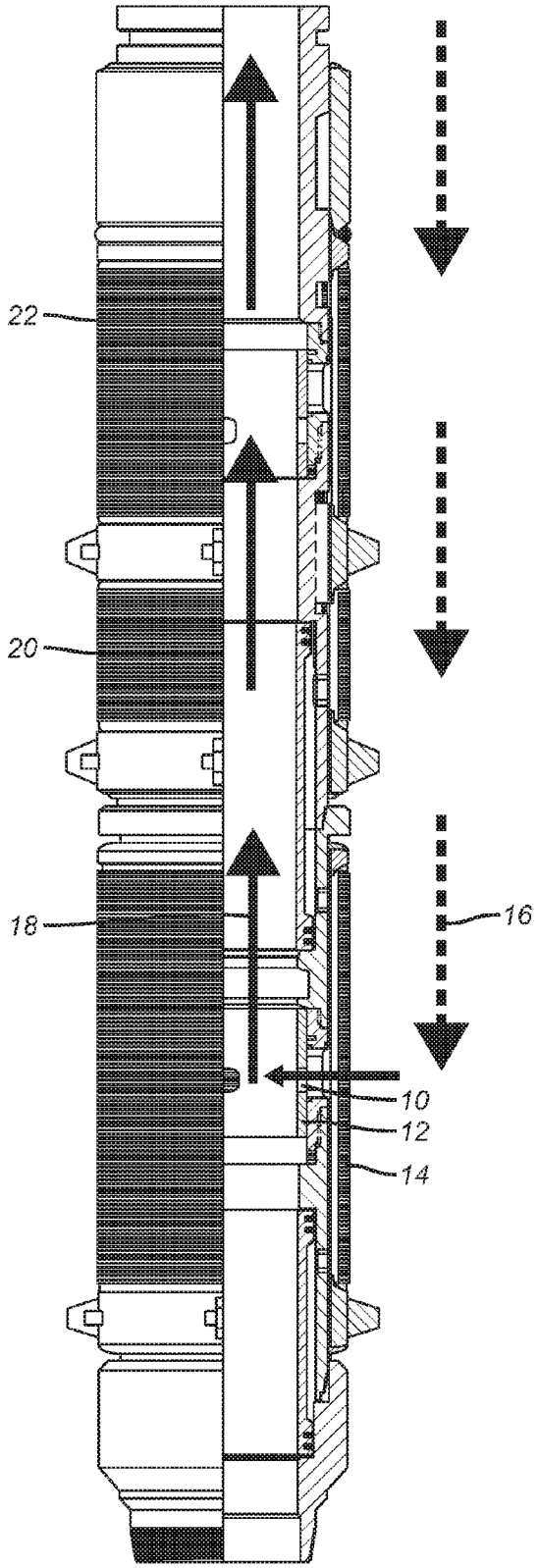
(PRIOR ART) FIG. 1
FIG. 1 shows a part section view of a prior art screen assembly with internal jumper flow paths between screens during gravel packing.
Figure 2:
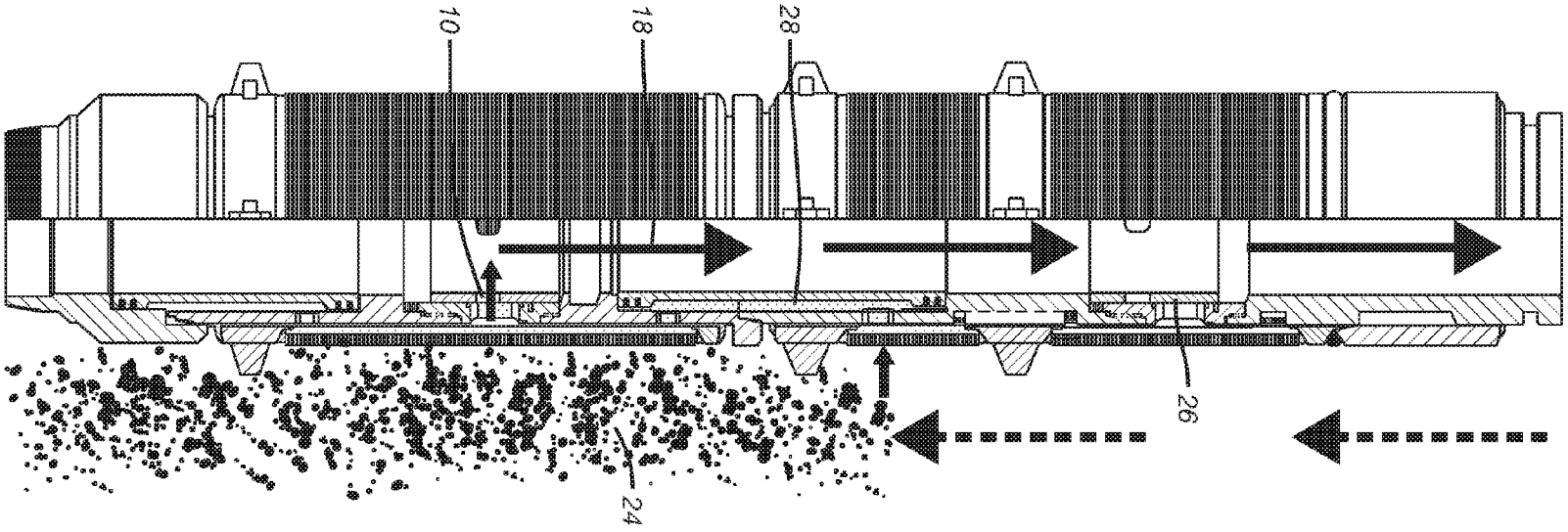
(PRIOR ART) FIG. 2
FIG. 2 is the view of FIG. 1 showing gravel deposition outside the screens and returns through a single open sliding sleeve valve.
Figure 3:
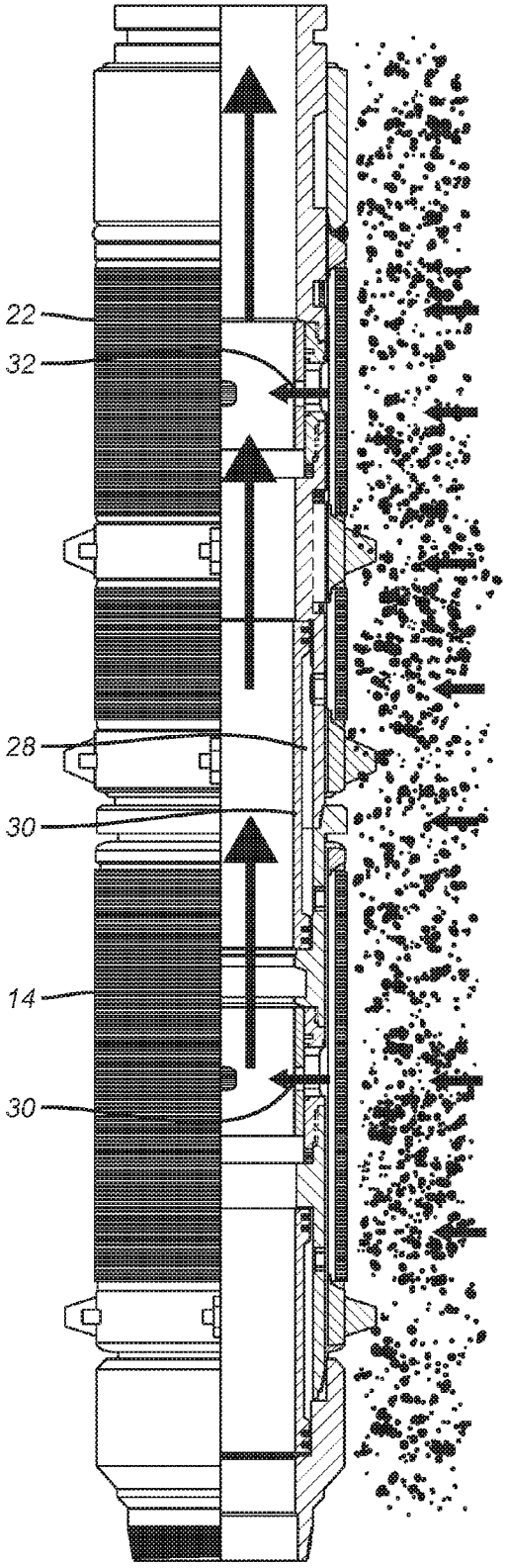
(PRIOR ART) FIG. 3
FIG. 3 is the view of FIG. 2 showing two sliding sleeves open during production.
Figure 6:
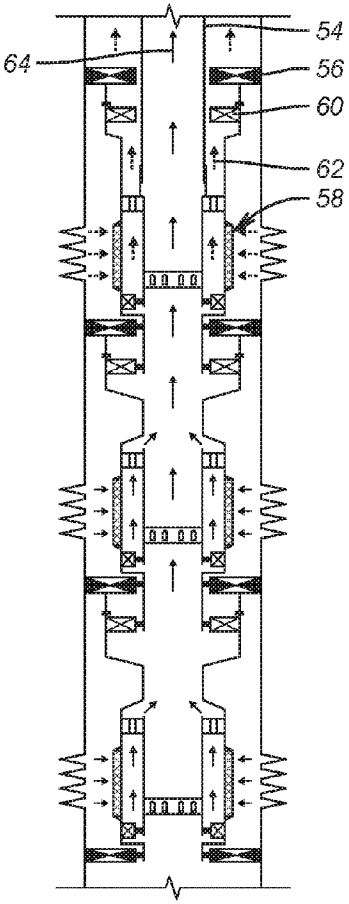
(PRIOR ART) FIG. 6
FIG. 6 is the view of FIG. 5 with the production string tagged into the production packer.
Figure 5:
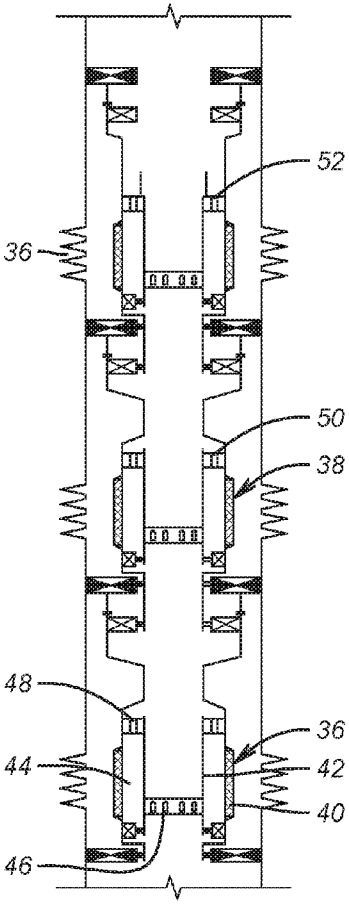
(PRIOR ART) FIG. 5
FIG. 5 is the view of FIG. 4 with all three zones perforated and completed.
Figure 4:
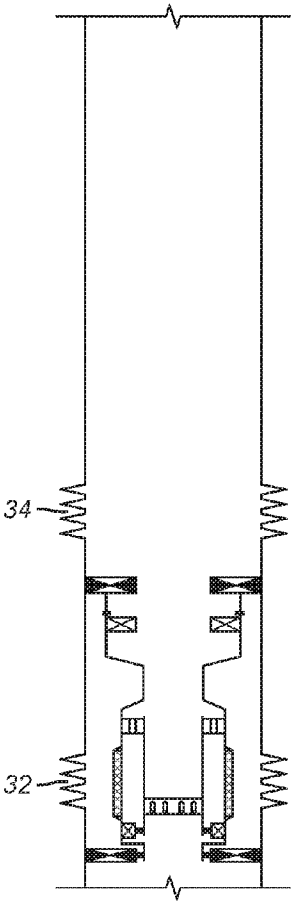
(PRIOR ART) FIG. 4
FIG. 4 is a schematic view of a prior art triple zone completion with the first zone completed and the second zone perforated.
Figure 7:
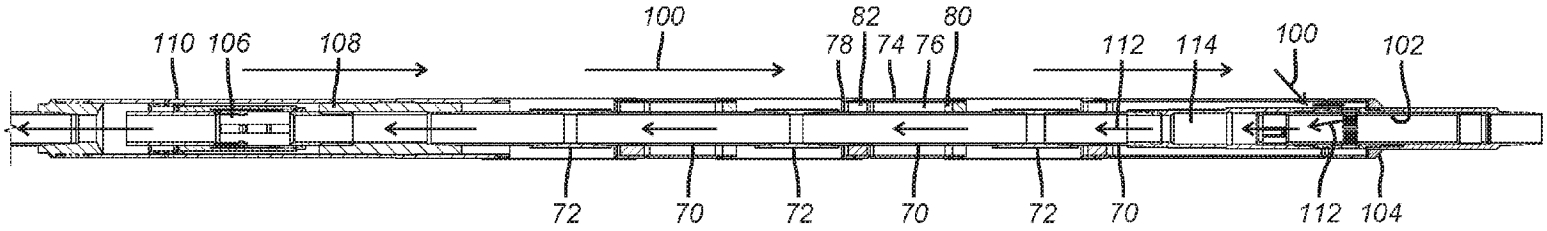
FIG. 7 is the assembly of the present invention during gravel packing.
Figure 10:
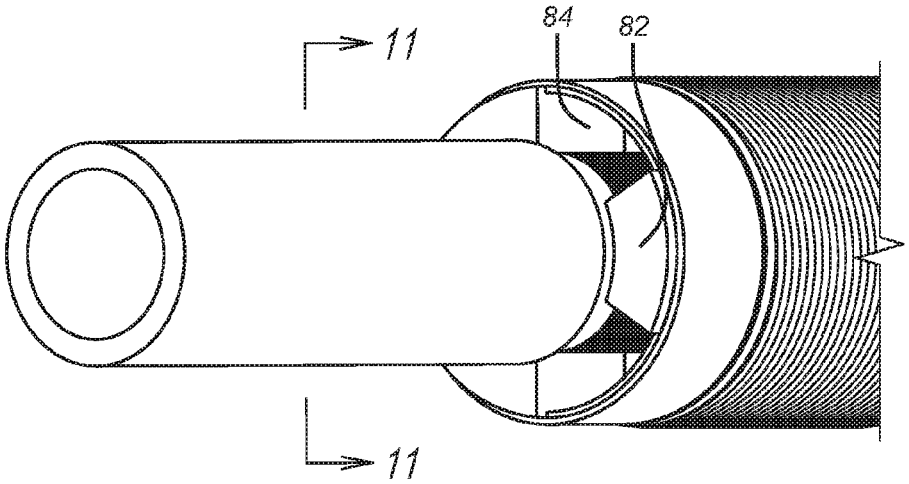
FIG. 10 is an end detail of a screen section showing communication openings through an end ring.
Figure 11:
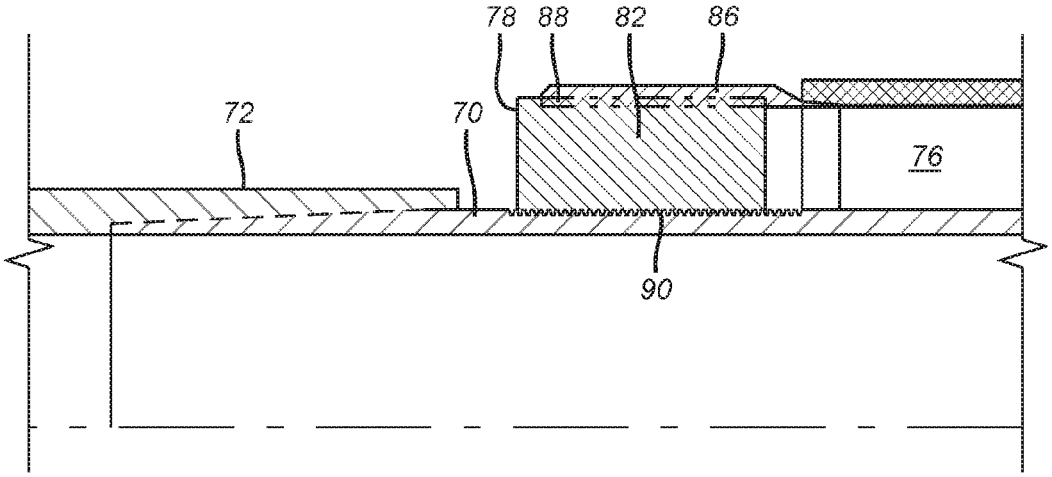
FIG. 11 is a section view along lines 11-11 of FIG. 10.

Referring to FIG. 7 an alternating assembly of base pipes 70 and couplings 72 is assembled at the surface. Each base pipe 70 has a surrounding screen 74 at a spaced relation to the base pipe 70 to define an annular space 76 that is open on opposing ends 78 and 80. Spacers 82 leave openings 84 as best seen in FIG. 10. Spacers 82 can be connected to end ring 86 at threads 88 while base pipe 70 is threaded at 90 to the spacers 82. Screen 74 can swaged onto the end ring 86 or fastened in other mechanical ways such as welding. The spacers 82 are preferably also welded to the end ring 86.

Figure 12:
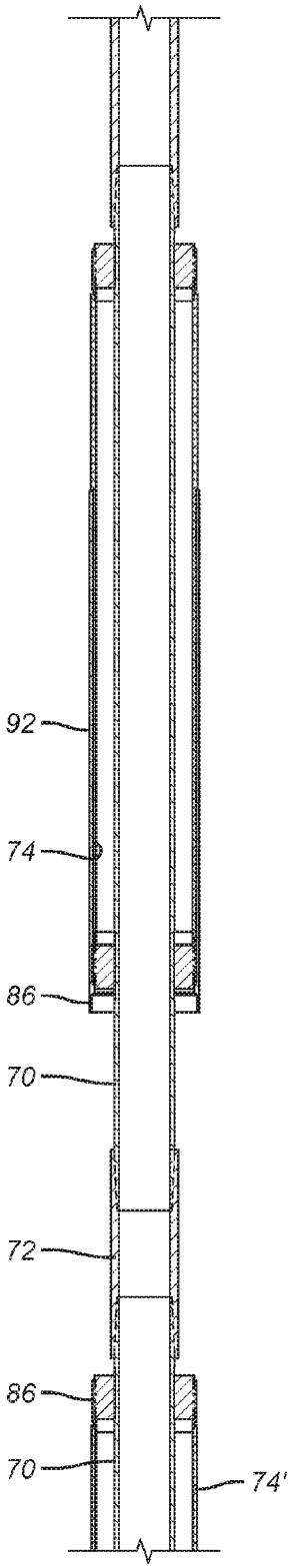
FIG. 12 is a view of two joints threaded together before the shroud is advanced to bridge adjacent screens.
Figure 13:
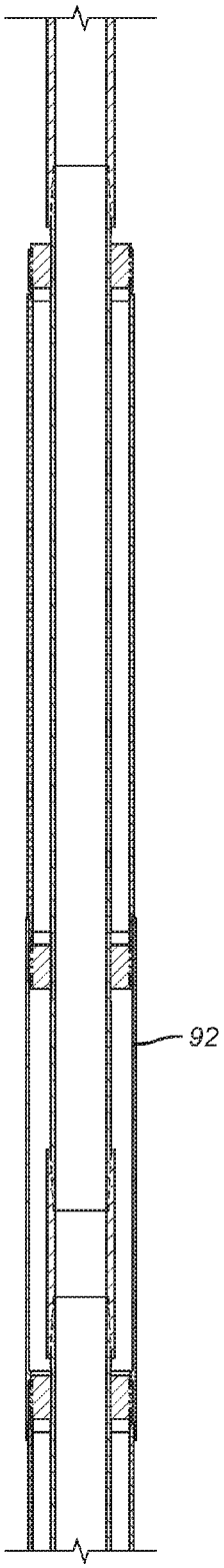
FIG. 13 is the view with a tubular jumper shroud advanced into position spanning two screen sections.

FIG. 12 illustrates the assembly method into the well. A lower screen 74' 70 is supported on the rig floor so that the next joint above can be aligned and the coupling 72 used to connect adjacent base pipes 70 with powered tongs that are not shown in the known manner. The upper base pipe 70 has a screen secured to it in the manner described above. It also can have a seamless tubularly shaped shroud 92 that is initially over the next screen 74 being added to the string. Once the new base pipe 70 is threaded to coupling 72 the shroud is lowered into position as shown in FIG. 13 so that is spans over the threads at opposed ends of the coupling 72. The shroud can be solid or it can have openings comparable to the opening size in the adjacent screens 74 to aid in gravel distribution during gravel packing. The additional openings in the shrouds 92 allow taking fluid returns through the shrouds when gravel packing, which brings the gravel to the shrouds 92 of a denser gravel pack. The ends of the shrouds 92 can be flexible and the inside diameter of the shroud is somewhat larger than the outside diameter of the underlying screen in FIG. 12 so that the shroud 92 can be manipulated into the FIG. 13 position for attachment to the end rings 86 that appear on opposed ends of screens 74 that mark the gap to be spanned by the shroud 92. Such attachment can be with fasteners such as countersunk bolts or circular clamps or the like. It should be noted that the shroud in this case can be a seamless tube or a tube with a welded seam, although seamless is preferred for greater structural integrity and avoidance of issues with chemical reaction with seam weld materials. Alternatively, the shroud 92 can be a split cylindrical shape with a longitudinal opening to allow it to be slipped over the base pipe 70 and the opening closed up. Another variation can be with the use of a hinged connection to allow an opposite side to be opened for advancing over the base pipe 70 and then closed up to secure the longitudinal edges together over the base pipe 70. The ends of the shroud 92 can then be connected to the end rings 86 in the manner described above.

Figure 8:
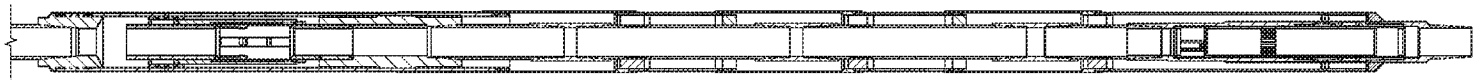
Figure 9:
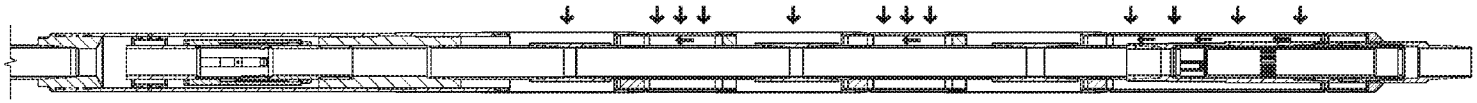
FIG. 9 is the view of FIG. 8 with the well on production.

FIGS. 7-9 show the end result of this process and the valves used preferably at opposed ends to facilitate gravel packing, isolation of the formation or production from the formation. FIG. 7 shows gravel slurry represented by arrows 100 entering annular space 76 that extends from gravel pack return valve 102 preferably at the lower end 104 to production valve 106 preferably at the upper end 110. Segments 108 are open to provide fluid access for screened production fluids to reach the valve 106. Valve 106 can be of a pressure to operate type or can be opened with mechanical intervention such as with a shifting tool. When valve 102 is open flow represented by arrow 112 enters the base pipe passage 114 leaving the gravel outside the screens and shrouds of the illustrated assembly. FIG. 8 shows the well shut in after gravel packing where valve 102 is closed as is valve 106. FIG. 9 shows valve 106 open to take production flow through all the screen sections and into the long annular space 76 and then into passage 114 to go to the surface.

Those skilled in the art will appreciate several advantages of the equipment described above and the method that such equipment enables. The screens communicate with each other outside the base pipes in a continuous annular space that allows the formation to be evenly produced. The drift dimension of the base pipe can be greater than prior designs for the same outer dimension of the screen assembly. A modular system facilitates rapid assembly and a lower overall cost. A single valve controls the elongated annular space for taking returns during gravel packing or for production. The production valve can be opened or closed without intervention such as with pressure cycles. Multiple zones can be produced and could ostensibly be balanced for even flow with strategically located obstructions to flow at desired locations. The shrouds can have openings to further enhance the distribution of the gravel by creating more fluid return paths. Screen modules are either open on one end or both ends depending on their placement to create an elongated annular space that allows more even flow from the formation into the passage formed by the connected base pipes.

The above description is illustrative of the preferred embodiment and many modifications may be made by those skilled in the art without departing from the invention whose scope is to be determined from the literal and equivalent scope of the claims below:

I claim:

1. A screen assembly for subterranean use, comprising:

at least one first screen module comprising a base pipe having a surrounding screen to define an annular space therebetween that is open on at least one end;

at least one second screen module comprising a base pipe having a surrounding screen to define an annular space therebetween that is open on at least one end;

said base pipes of said modules are connected with at least one connection such that said annular space open ends face each other;

at least one shroud mounted over said connection and secured on opposed ends adjacent said screens to extend said annular space between said open ends;

at least one valve for selectively communicating said annular space and a passage defined within said base pipe and said connection;

said at least one valve comprises two spaced valves adjacent opposed ends of said extended annular space to selectively allow flow through said screens during gravel packing and during production.

2. The assembly of claim 1, wherein:

said first and second screen modules comprising spaced members extending in respective said annular spaces between a respective base pipe and an end ring, said screen from a respective module is attached to a respective end ring.

3. The assembly of claim 1, wherein:

respective screens from each module are swaged onto associated said end rings for connection thereto.

4. The assembly of claim 1, wherein:

respective screens from each module are connected to associated said end rings with at least one fastener.

5. The assembly of claim 1, wherein:

said shroud comprises a tubular shape that is seamless or has a welded seam.

6. The assembly of claim 1, wherein:

said shroud comprises a longitudinally split tubular shape for placement over said connection, said split further comprising a closure for said split.

7. The assembly of claim 1, wherein:

said two spaced valves selectively closed to prevent flow through said screens.

8. The assembly of claim 1, wherein:

at least one of said valves are responsive to applied pressure to open.

9. The assembly of claim 1, comprising:

at least one port in said shroud.

10. A completion method for subterranean use, comprising;

running in an assembly of screen joints comprising base pipes connected with at least one connection with at least one shroud spanning between screens on connected base pipes and over said connection to form a continuous elongated annular space between said base pipes and said screens selectively communicated to a passage within base pipes with at least one valve;

opening said valve to take flow through said screens, said annular space and said passage;

providing at as said at least one valve, spaced valves selectively communicating to said annular space;

taking returns when gravel packing through a first of said valves;

taking production from a surrounding formation through a second of said valves.

11. The method of claim 10, wherein:

providing distributed flow from across a formation through said screens into said elongated annular space.

12. The method of claim 10, wherein:

using spaced members to separate a respective said screen from a respective base pipe while permitting flow therebetween for continuity of said annular space.

13. The method of claim 10, wherein:

providing seamless or welded seam tubular as said shroud or a tubular with a closable longitudinal split as said shroud.

14. The method of claim 12, wherein:

using an end ring to retain said spaced members to a respective base pipe;

swaging an end of a said screen to said end ring when creating said annular space.

15. The method of claim 10, wherein:

opening said valve with applied pressure in said connected base pipes.

16. The method of claim 10, comprising:

providing at least one port in said shroud.

17. A screen assembly for subterranean use, comprising:

at least one first screen module comprising a base pipe having a surrounding screen to define an annular space therebetween that is open on at least one end;

at least one second screen module comprising a base pipe having a surrounding screen to define an annular space therebetween that is open on at least one end;

said base pipes of said modules are connected with at least one connection such that said annular space open ends face each other;

at least one shroud mounted over said connection and secured on opposed ends adjacent said screens to extend said annular space between said open ends;

at least one valve for selectively communicating said annular space and a passage defined within said base pipe and said connection;

said first and second screen modules comprising spaced members extending in respective said annular spaces between a respective base pipe and an end ring, said screen from a respective module is attached to a respective end ring;

said spaced members are secured to a respective said base pipe with threads;

said spaced members are secured to a respective end ring with threads.

18. The assembly of claim 17, wherein:

said spaced members are secured to a respective said base pipe with welding;

said spaced members are secured to a respective end ring with welding.

19. A completion method for subterranean use, comprising;

running in an assembly of screen joints comprising base pipes connected with at least one connection with at least one shroud spanning between screens on connected base pipes and over said connection to form a continuous elongated annular space between said base pipes and said screens selectively communicated to a passage within base pipes with at least one valve;

opening said valve to take flow through said screens, said annular space and said passage;

using spaced members to separate a respective said screen from a respective base pipe while permitting flow therebetween for continuity of said annular space;

using an end ring to retain said spaced members to a respective base pipe;

swaging an end of a said screen to said end ring when creating said annular space;

connecting said end ring to said spaced members and said spaced members to a respective base pipe with threading.

* * * * *